US005871003A

United States Patent [19]

Laporte et al.

[11] Patent Number: 5,871,003

[45] Date of Patent: Feb. 16, 1999

[54] APPARATUS FOR THE DOUBLE LAUNCHING OF TARGETS CALLED CLAY PIGEONS

[75] Inventors: Jean Michel Laporte, Biot; Paul Panara, Villeneuve Loubet, both of France

[73] Assignee: Laporte Ball Trap (S.A.R.L.), Vauvert, France

[21] Appl. No.: 849,849

[22] PCT Filed: Dec. 8, 1995

[86] PCT No.: PCT/FR95/01625

§ 371 Date: Jun. 13, 1997

§ 102(e) Date: Jun. 13, 1997

[87] PCT Pub. No.: WO96/18864

PCT Pub. Date: Jun. 20, 1996

[30] Foreign Application Priority Data

Dec. 13, 1994 [FR] France ..... 94 15277

[51] Int. Cl.[6] ..... F41J 9/18

[52] U.S. Cl. ..... 124/9; 124/8

[58] Field of Search ..... 124/8, 9, 46, 47, 124/48

[56] References Cited

U.S. PATENT DOCUMENTS

| | | | |
|---|---|---|---|
| 3,070,082 | 12/1962 | Foster | 124/8 |
| 3,097,635 | 7/1963 | Freeman | 124/8 |
| 3,119,383 | 1/1964 | Foster | 124/8 |
| 3,304,928 | 2/1967 | Darrell | 124/47 |
| 3,722,495 | 3/1973 | Hansen | 124/8 |
| 3,923,033 | 12/1975 | Laporte et al. | 124/8 |
| 3,937,203 | 2/1976 | Riedmueller et al. | 124/8 |
| 4,048,976 | 9/1977 | Alday et al. | 124/47 |
| 4,699,116 | 10/1987 | Freeland et al. | 124/7 |
| 5,036,828 | 8/1991 | Heffer | 124/47 |

FOREIGN PATENT DOCUMENTS

| | | |
|---|---|---|
| 0 592 344 | 4/1994 | European Pat. Off. . |
| 2 189 154 | 10/1987 | United Kingdom . |

*Primary Examiner*—John A. Ricci
*Attorney, Agent, or Firm*—Young & Thompson

[57] ABSTRACT

The apparatus is comprised of two launchers (6, 7) having the same technical characteristics, arranged next to each other. One of the launchers is symmetrical to the other one with respect to a vertical symmetry plane which separates them. Both launchers (6, 7) have their own launching ramp (8 and 9) and their launching arm (4, 5), each at a different level, and are mounted integrally with an oscillating plate (10). The oscillating plate (10) is mounted on an oscillation shaft (11) of a base plate (12) which forms the fixed base of the apparatus. The apparatus is used in sport shooting.

8 Claims, 3 Drawing Sheets

APPARATUS FOR THE DOUBLE LAUNCHING OF TARGETS CALLED CLAY PIGEONS

FIELD OF THE INVENTION

The present invention has for its object an apparatus for the double launching of targets called clay pigeons.

BACKGROUND OF THE INVENTION

For sport shooting, it is interesting for the shooter to shoot a double. The launching apparatus must launch simultaneously two targets called clay pigeons. The lavnching of this double must be carried out according to very precise standards as to the identical or different trajectories of the targets, as to the angle of spacing of the respective trajectories, as to their departure, their altitude, etc.

Up to the present, there are specific machines for double launching. These machines are very cumbersome in that they cannot serve other than for double shooting. The adjustments of the double are often laborious and cannot be carried out other than by persons completely understanding the machine.

Another problem also arises for apparatus for launching targets, concerning the supply of the drums of the targets. The drums, in competition, must be often resupplied. This often poses problems of manipulation.

The state of the art can be defined by the following patents:

French patent application filed Sep. 2, 1993 under No. 93.10640: apparatus of the type for launching clay pigeons or movable targets for sport shooting using a rotatable supply drum for movable targets, one or several motors ensuring the rotation of the rotatable drum and the movement of the ejection arm, actuating means in rotation ensuring the rotation of the assembly on the support which is anchored to the ground, characterized by the fact that the drum assembly, launching ramp, motors, are articulatedly mounted on an assembly support which surrounds a vertical axle secured to the anchoring support; a motor ensures, by a cam and an articulation rod, the adjustment of the horizontal positioning of the shooting axis and the opening of the horizontal angle.

EP-0592.344 A1: apparatus for launching targets for shooting whose speed and distance of projection are variable, of the type using a rotatable drum into which are loaded movable targets; the movable targets are superposed on each other in columns, maintained by tubes or vertical rollers disposed between an upper recessed holding plate or having radial arms for storage of movable targets and a lower recessed holding plate at the level of each column of targets or having arms radiating between each column of targets; said lower plate being in upper position parallel to a fixed base plate which comprises a single recess so as to permit the passage of movable targets which are received on a launching plate disposed in front of an ejection arm, one or several motors ensuring the rotation of the drum and the movement of the ejection arm characterized by the fact that the launching plate is comprised by a fixed launching ramp and a movable launching ramp are articulated about a substantially transverse pivoting axis wherein the upper surfaces of said ramps are at a same height lower than and parallel to the trajectory of the assembly of the ejection arm.

The launcher is comprised of a chassis which is movably mounted on a base, vertically and horizontally movably. On the chassis are mounted two independent launching arms, each adjacent a supply magazine, said magazines can be loaded with different sized targets. A vertically movable plate permits supplying the targets toward the common launching plate to the two launching arms. A transmission controls both the cocking of the arms and the supply of the targets by a set of springs, pulleys, chains and rods.

This latter patent discloses on the one hand the drawback of a specific launcher for double launching and on the other hand the complexity of production and adjustment of said launcher so that the double firing will be perfect.

The apparatus according to the invention overcomes all these drawbacks.

It permits producing a launcher particularly for double firing and this, essentially with material already existing and whose reliability is known. It increases the autonomy of a launcher because of the double supply drums.

SUMMARY OF THE INVENTION

To this end, the apparatus for double launching of targets called clay pigeons is of the type using two rotatable target supply drums, one or several motors ensuring the rotation of the drums and the movements of the launching arms, characterized by the fact that it is comprised of two launchers having the same characteristics, disposed side by side, one being symmetrical to the other relative to a plane of vertical symmetry which separates them, the two launchers having their launching ramp and their launching arms each at a different level, they being mounted securely to an oscillating plate, said oscillating plate being mounted on an axis of oscillation of a base plate which forms the fixed base of said apparatus.

The oscillating plate is provided with adjustment means which permit adjusting the angle of spacing between the launching angle of a launcher relative to the launching angle of the other launcher so as to define the spacing angle between the two trajectories of the targets.

Each launcher has the axis of rotation of the launching arm which is coaxial with the pivotal axis of said launcher, the pivotal axis of each launcher is located in the oscillation plane common to the two launchers.

Adjustment means of the spacing angle between the launching axis of a launcher and the other launching axis of the other symmetrical launcher are holes for preadjustment provided for this purpose on the oscillation plate common to the two launchers. Each series of holes is disposed on the side opposite the pivotal axis of the launcher.

The oscillating plate common to the two launchers is at two levels, a level for one launcher, another level for the other symmetrical launcher and this so that the launching ramps and the launching arms of one can be superposed on those of the other launcher.

The oscillating plate is actuated oscillably on its axis by a motoreducer. The oscillation motoreducer is connected by a connection axle, rod and oscillating plate.

BRIEF DESCRIPTION OF THE DRAWINGS

The accompanying drawings are given by way of example and are non-limiting. They show a preferred embodiment according to the invention. They permit easy comprehension of the invention.

DETAILED DESCRIPTION OF THE INVENTION

The longitudinal axes of the launching ramps which are superposed are not on the same axis and form between them a spacing angle of the trajectories in the horizontal plane.

Figure 1:
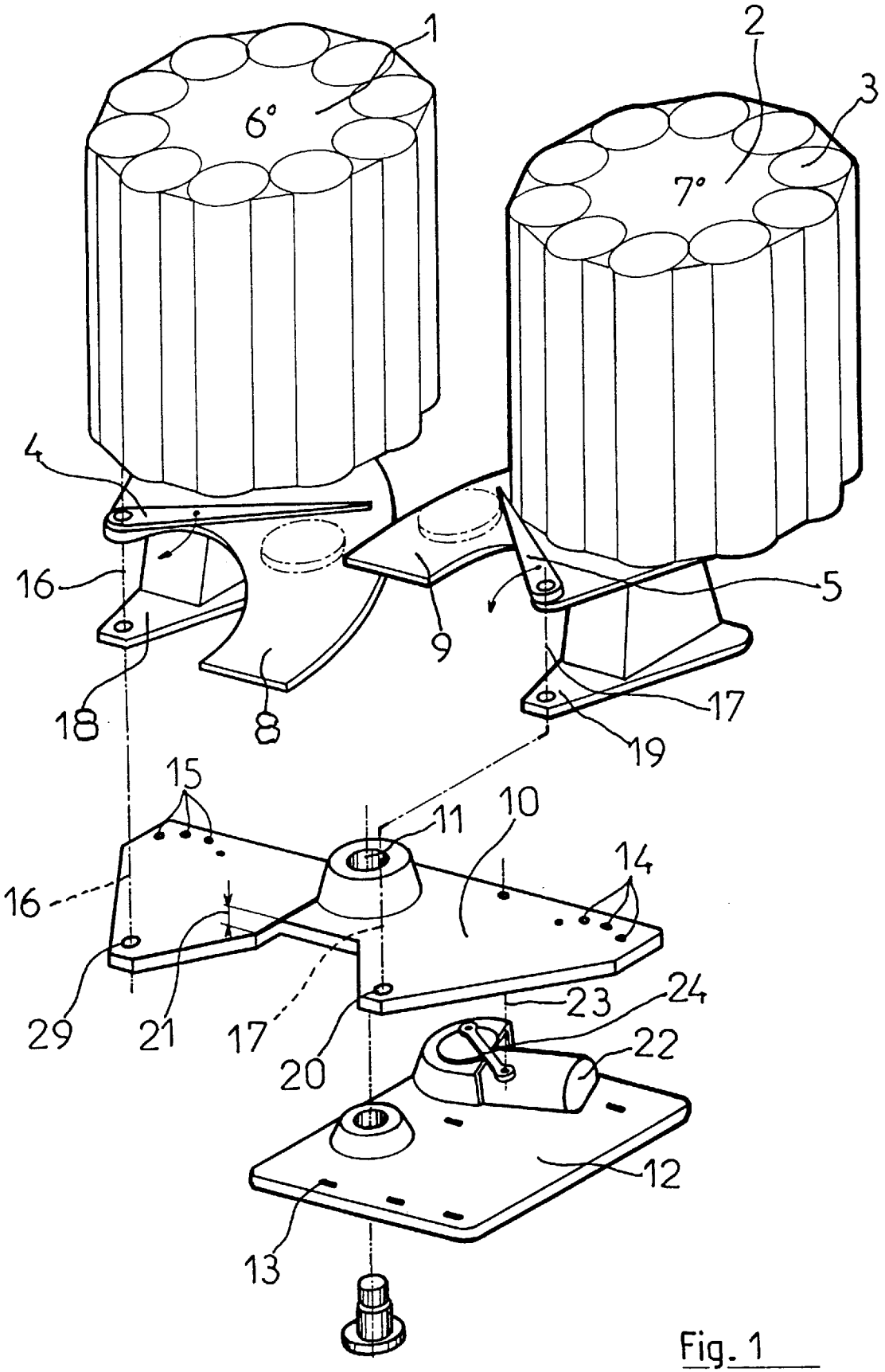
FIG. 1 is a schematic view of the apparatus shown exploded so as to display the arrangement of the two launchers, of which one is symmetrical to the other as well as their connecting members.

The double launching apparatus, as shown in FIG. 1, is of the type using two drums 1 and 2 for supplying targets 3. One or several motors, not shown in FIG. 1, ensure the rotation of the drums 1, 2 and the movements of the ejection arms 4 and 5.

The apparatus is characterized by the fact that it is comprised of two launchers 6, 7 having the same technical characteristics disposed side by side. One is symmetrical to the other, relative to a vertical plane of symmetry which separates them.

The two launchers 6 and 7 have their launching ramps 8 and 9 disposed each at a different level. These two launchers 6 and 7 are mounted fixedly on an oscillating plate 10. This oscillating plate 10 is mounted on an oscillation axle 11 of a base plate 12 which forms the fixed base of said apparatus. This base plate 12 is fixed by securement means, by means of holes 13, on the surrounding structure.

The oscillating plate 10 is provided with adjustment means 14 and 15 which permit adjusting the spacing angle between the launching axis of one launcher 6 relative to the launching axis of the other launcher 7 which itself is symmetrical and this so as to define the spacing angle between the two trajectories of the targets.

The launching axis of one launcher corresponding to the longitudinal axis of the launching ramp 8 or 9 of each launcher 6, 7.

Each launcher 6, 7 has its axis of rotation of its launching arms 4 or 5 coaxial with the pivotal axis 16 or 17 of said launcher 6 or 7. The pivotal axis 16 or 17 of each launcher 6 or 7 is located on the oscillation plate 10. This pivotal axis passes through a hole disposed in the level of the front portion of the sole 18, 19 of the two launchers 6 and 7. This sole 18 and 19 is fixed, by its opening by securement means located in the corresponding opening 29, 20 located on the front portion of the oscillation plate 10.

The adjustment means 14 and 15 of the spacing angle between the launching axis of one launcher 6 and the other launching axis of the symmetrical other launcher 7, comprise preadjustment holes 14 and 15 provided for this purpose on the oscillation plate 10, common to the two launchers 6 and 7. Each series of holes 14 and 15 is disposed on the side opposite the pivotal axis 16 or 17 of the launcher 6 or 7.

As shown in FIG. 1, the oscillating plate 10, common to the two launchers 6 and 7, is at two levels. One level for a launcher 6 and the other level for the other launcher 7 and this such that the launching ramps 8, 9 and the launching arms 4 and 5 can be superposed relative to those of the other launcher 6 or 7. The two levels are shown by arrows 21 which indicate an offset of the level on the oscillating plate 10.

The oscillating plate 10 is actuated in oscillation on its axle 11 by a motoreducer 22.

This motoreducer is connected, by a connection axle 23 disposed at the end of a rod 24, which rod permits oscillation of said plate 10. This rod 24 is provided with a known system permitting adjustment of oscillation.

Figure 2:
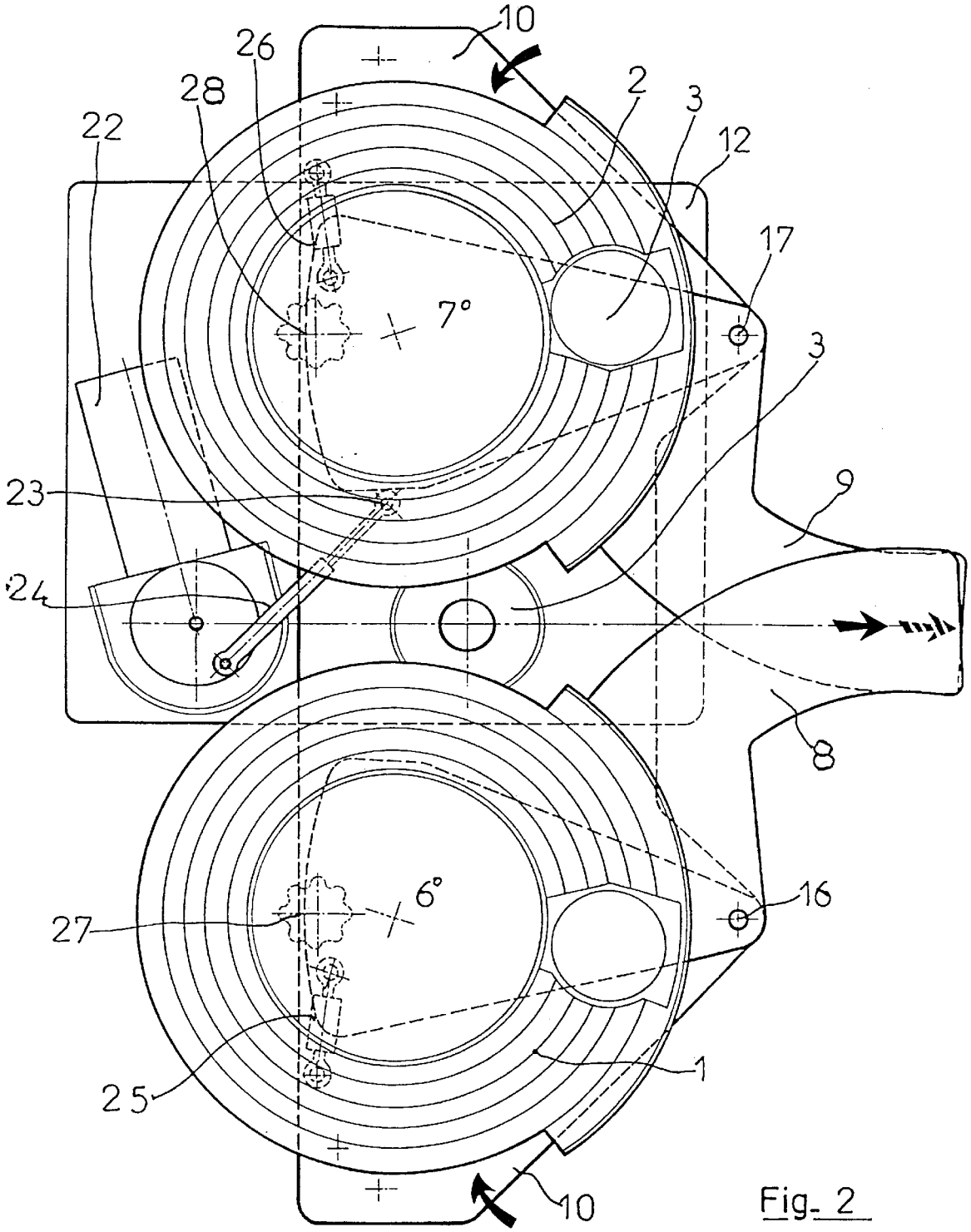
FIG. 2 is a plan view of the apparatus showing the two launchers, the principal members and the adjustment and actuating means for said adjustments; in this embodiment, the double trajectory is simple. The longitudinal axes of the launching ramps of the launchers are on the same axis.

FIGS. 1 and 2 permit visualizing several other adjustment means or blocking means for the respective position of the two launchers 6 and 7.

Adjustable levers 25 and 26 permit the end adjustment of the position of the launchers 6 and 7 on the oscillating plate 10.

A locking knob 27 or 28 permits immobilizing the launchers 6 and 7 after having adjusted their trajectories.

FIG. 2 also permits visualizing the two launchers 6 and 7 which have been oriented by their pivotal axis 16, 17 such that their launching ramp 8 and 9 will be on a single launching axis. There is thus only a single trajectory, which is a simple trajectory for the two targets. The spacing angle is zero. The two launchers 6, 7 are in the same alignment.

Figure 3:
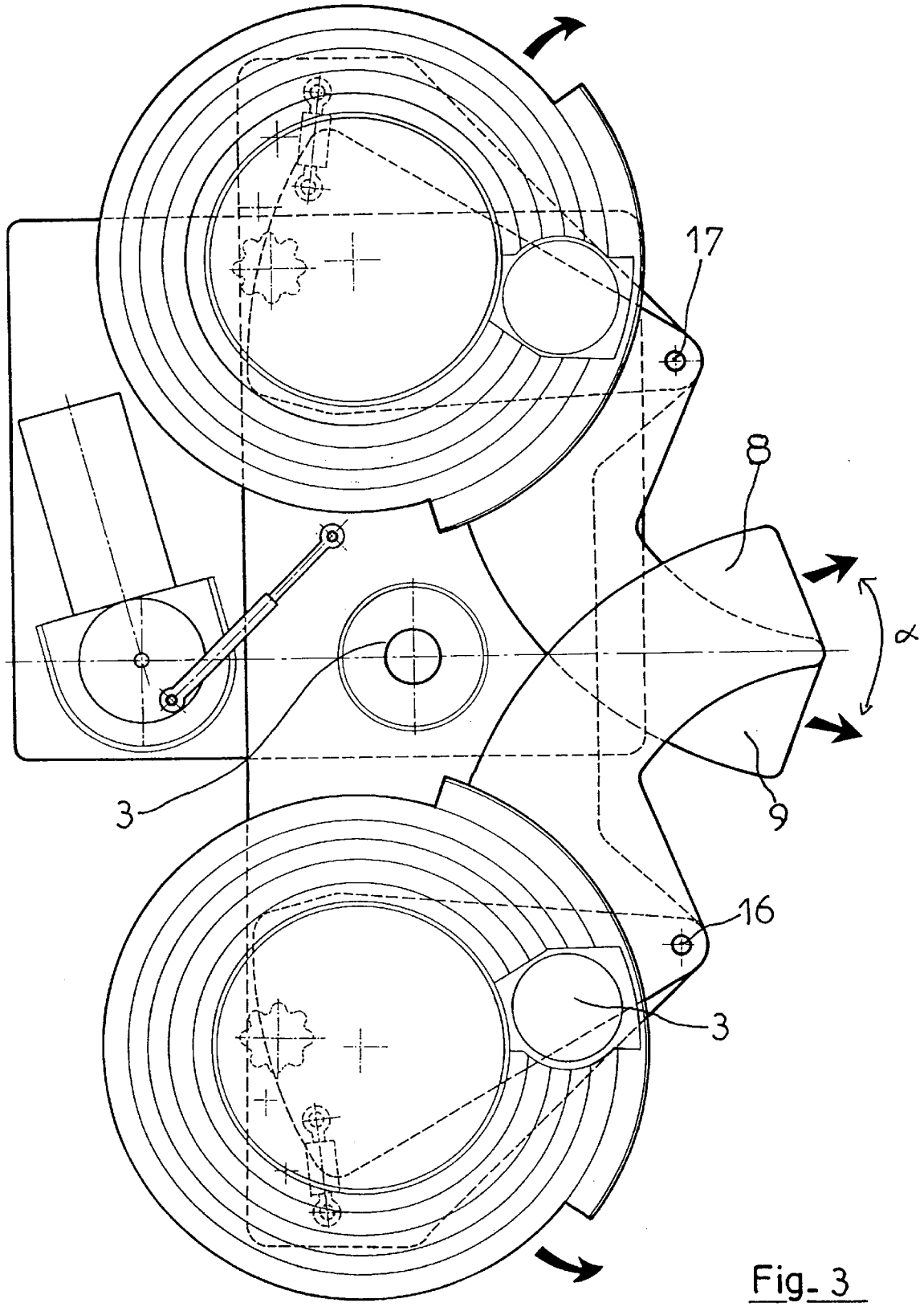
FIG. 3 is a plan view of the apparatus showing the two launchers, the principal members and the adjustment and actuating means of said adjustments; in this embodiment, the trajectories of the doubled targets are different.

On the contrary, in FIG. 3, the two launchers 6 and 7 have been pivoted relative to their pivoting axis 16 and 17 on the oscillating plate 10, such that the longitudinal axis of their launching ramp 8 and 9 forms an angle which is a spacing angle permitting obtaining two different trajectories. The spacing angle a is for example 45°.

REFERENCES

1. 2. Supply drum
3. Targets
4. 5. Ejection arm
6. 7. Launchers
8. 9. Launching ramp
10. Oscillating plate
11. Axis of oscillation
12. Base plate
13. Holes
14. 15. Adjustment means which are preadjusting holes
16. 17. Pivotal axis
18. 19. Sole
29. 20. Opening
21. Arrows
22. Motoreducer
23. Connection axle
24. Rod
25. 26. Adjustable levers
27. 28. Locking knob

We claim:

1. Apparatus for the double launching of targets called clay pigeons, using two rotatable drums for supplying targets, at least one motor for rotation of the drums and movement of ejection arms, the apparatus further comprising:

a first launcher and a second launcher, said launchers having essentially the same technical characteristics, and being disposed side by side, the first launcher being symmetrical relative to the second launcher about a vertical plane of symmetry which separates the launchers, each launcher having a launching ramp and a launching arm, the launching ramp and launching arm of the first launcher being at a different level than the launching ramp and launching arm of the second launcher, and the launchers being secured to an oscillating plate mounted on an oscillating axle of a base plate.

2. Apparatus according to claim 1, wherein the oscillating plate is provided with adjustment means which permit adjusting the spacing angle between the launching axis of the first launcher relative to the launching axis of the second launcher so as to define the spacing angle $\alpha$ between the two trajectories of the targets of each launcher.

3. Apparatus according to claim 2, wherein the adjustment means comprise a series of preadjustment holes provided on the oscillating plate common to the two launchers; each series of holes being disposed on the side opposite the pivotal axis of the corresponding launcher.

4. Apparatus according to claim 1, wherein each launcher has a pivotal axis, and an axis of rotation of the launching arm which is coaxial with the pivotal axis of said launcher, the pivotal axis of each launcher being located in the oscillating plate common to the two launchers.

5. Apparatus according to claim 1, wherein the oscillating plate common to the two launchers has two levels, one level for the first launcher, and another level for the second symmetrical launcher, such that the launching ramp and the launching arm of one launcher can be superposed on the launching ramp and launching arm of the other launcher.

6. Apparatus according to claim 1 wherein the oscillating plate is actuated in oscillation on its axle by a motoreducer; said oscillation motoreducer being connected by a connecting axle, a rod and the oscillating plate.

7. Apparatus according to claim 6, wherein the connecting axle is disposed at the end of the rod; said rod permitting oscillation of said oscillating plate; said rod being provided with a system permitting oscillation adjustment.

8. Apparatus according to claim 7, further comprising adjustable levers which permit end adjustment of the position of the launchers on the oscillating plate; and a locking knob permitting immobilizing the launchers after having adjusted their trajectories.

* * * * *